United States Patent [19]

Akagi et al.

[11] Patent Number: 4,986,233

[45] Date of Patent: Jan. 22, 1991

[54] IGNITION DEVICE FOR AN ENGINE

[75] Inventors: Motonobu Akagi, Anjo; Yoshiyuki Okamoto, Kariya, both of Japan

[73] Assignee: Aisin Seiki Kabushiki Kaisha, Kariya, Japan

[21] Appl. No.: 407,587

[22] Filed: Sep. 15, 1989

[30] Foreign Application Priority Data

Sep. 30, 1988 [JP] Japan ..... 63-128248

[51] Int. Cl.[5] ..... F02P 15/00

[52] U.S. Cl. ..... 123/634; 123/169 PA; 123/635

[58] Field of Search ..... 123/169 PA, 169 PH, 123/634, 635

[56] References Cited

U.S. PATENT DOCUMENTS 4,706,639 11/1987 Boyer et al. ..... 123/635 X 4,834,056 5/1989 Kawai ..... 123/635 X

*Primary Examiner*—Tony M. Argenbright

*Attorney, Agent, or Firm*—Oblon, Spivak, McClelland, Maier & Neustadt

[57] ABSTRACT

An ignition device for an engine is removable without removing the cylinder head cover, for gaining access to the spark plug. A case has a lower portion releasibly fitted around a spark plug mounted to a cylinder head of the engine. First and second bobbins having coils wound thereon are mounted concentrically in the case and a C-shaped core is positioned outside of the case and has distal ends fitted in the bobbins. An ignition head cover removably mounted to the cylinder head cover of the engine supports the core when the lower portion of the case is fitted around a spark plug.

6 Claims, 3 Drawing Sheets

IGNITION DEVICE FOR AN ENGINE

BACKGROUND OF THE INVENTION

1. Field of the Invention

The present invention relates to an ignition device and more particularly to an ignition device for an internal combustion engine of a vehicle, etc.

2. Discussion of the Background

In general, a single ignition coil of a normal engine is located on the engine for an ignition spark plug, and the single ignition coil is connected to all of the ignition spark plugs by a high-tension wire. It is also known to locate an ignition coil at each portion of the engine where each ignition spark plug is fixed to the engine and to directly connect each ignition coil with its respective ignition spark plug, since electrical loss is very large in the high-tension wire.

A conventional ignition device related to the present invention is disclosed in Japanese Utility Model Laid-open No. 63-67646 published on May 5, 1988, and is shown in FIG. 5. There, an engine 71 has plural cylinders (not shown). Each cylinder is formed in a cylinder block having a head 72 which is covered with a cylinder head-cover 73. The engine has two cam-shafts 74 and cam-shafts stoppers 75. The number of ignition spark plugs 76 and the number of ignition coils 77 are the same as the number of the cylinders. Each ignition spark plug 76 is fixed to the cylinder head 72 in the corresponding plug hole 78. Respective plural sleeves 79 are fixed to the corresponding plug holes 78. Each ignition coil 77 is held between the cylinder headcover 73 and the corresponding sleeve 79 via a gasket 80.

The above-mentioned ignition device has several disadvantages. Namely, if a disconnection of the ignition coil 77 or a damage of the ignition spark plug 76 occurs, the cylinder head-cover 73 must be removed for repairing the ignition coil 77 or the ignition spark plugs 76. This is very cumbersome work and repetition of such work damages the gasket 80. Thus, the sealing function of the gasket 80 is impaired, so that lubricating oil for the engine 71 leaks through the gasket 80 and causes malfunctions.

SUMMARY OF THE INVENTION

Accordingly, it is a primary object of the present invention to provide an ignition device which can be repaired when a disconnection of the ignition coil or a damage of the ignition spark plug occurs.

The above, and other, objects are carried out according to the present invention by an ignition device for an engine, comprising a case having a lower portion releasibly fitted around a spark plug mounted to a cylinder head of the engine; a first bobbin having a coil wound thereon, the first bobbin being supported by the case and the first coil being connectable to an ignition system of the engine; a second bobbin having a second coil wound thereon, the second bobbin being supported by the case concentric with the first bobbin, means for electrically connecting the second coil to a spark plug around which the lower portion of the case is fitted; and a C-shaped core positioned outside of the case and having distal ends fitted in the bobbins. An ignition head cover removably mounted to a cylinder head cover of the engine supports the core when the lower portion of the case is fitted around the spark plug, so that the ignition device may be removed from the spark plug without removing the cylinder head cover from the cylinder head.

According to a further feature of the invention, the center part of the core is mounted above the case.

According to a further feature of the invention, damper means are positioned between the core and the cylinder head cover such that the core is held by the cylinder head cover via the damper means.

According to a further feature of the invention, the core forms a gap in the bobbins, whereby electro-magnetic energy is transferred from the first coil to the second coil.

According to a further feature of the invention, the lower portion of the case fits in a rubber sleeve fixed to the cylinder head around a hole for the spark plug.

According to a further feature of the invention, the core is formed of two stacks of conductive plates held together by end pieces.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 2:
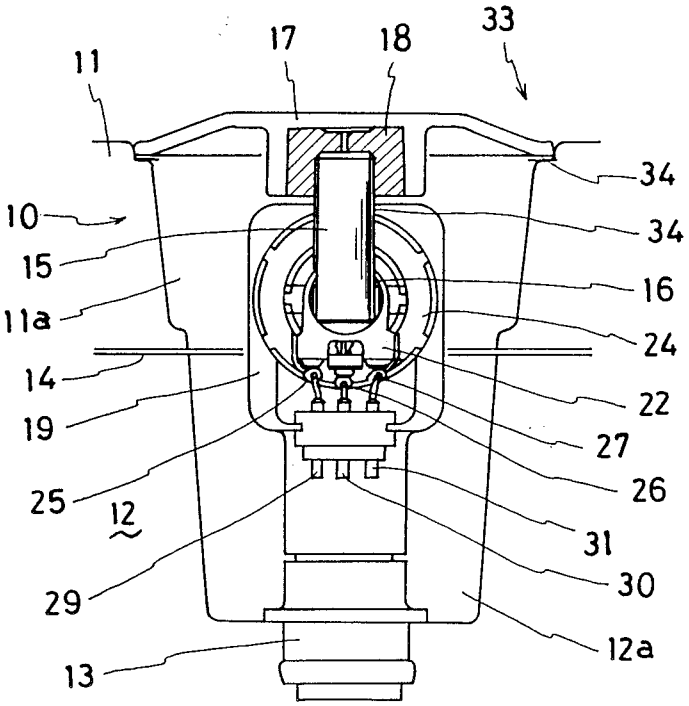
FIG. 2 is a side elevational view of an ignition device according to the invention.
Figure 1:
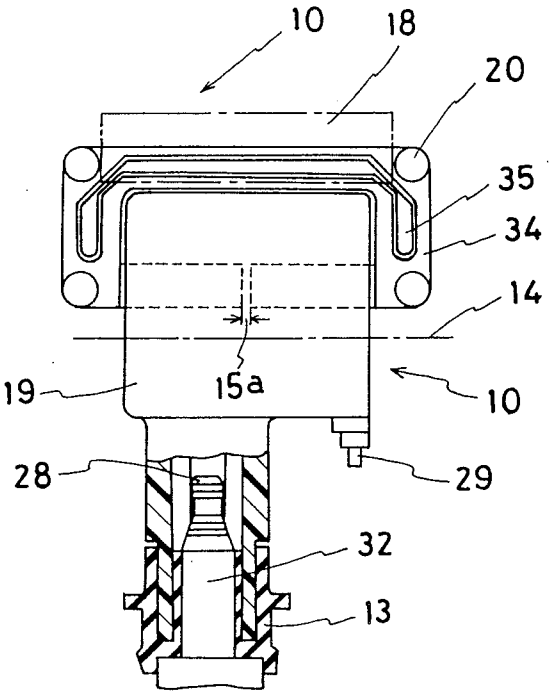
FIG. 1 is a front elevational view of an ignition device in which the present invention is employed.
Figure 3:
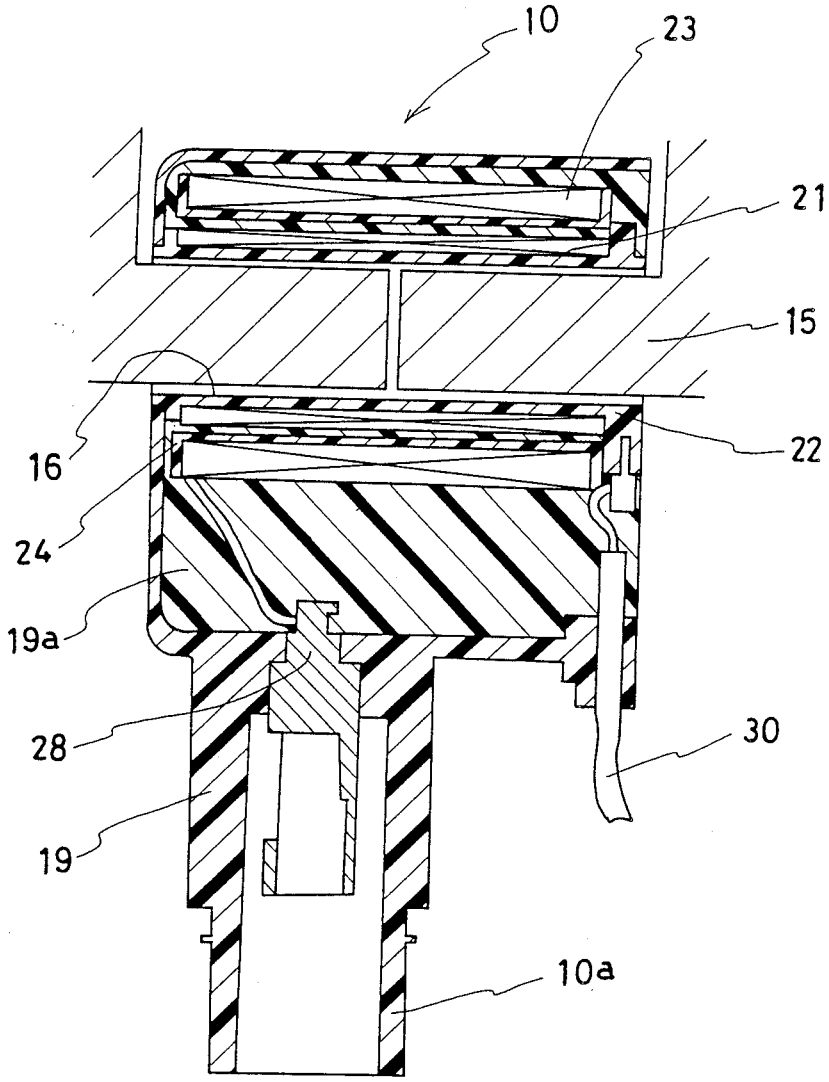
FIG. 3 is a large-scaled cross-sectional view of an ignition device according to the invention.

Referring to FIGS. 1 through 4 wherein an ignition device 10 is shown, a cylinder head-cover 11 of a multi-cylinder engine 33 is fixed to a cylinder head 12 by bolts (not shown), via a gasket 14. A rubber sleeve 13 is fixed to the cylinder head 12 in a depression **12*a*** of the head.

Figure 4:
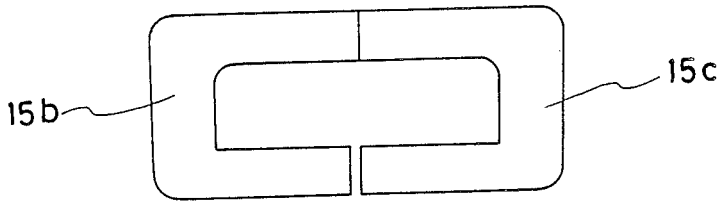
FIG. 4 is a front view of one of the plates which constitutes the C-shaped core.
Figure 5:
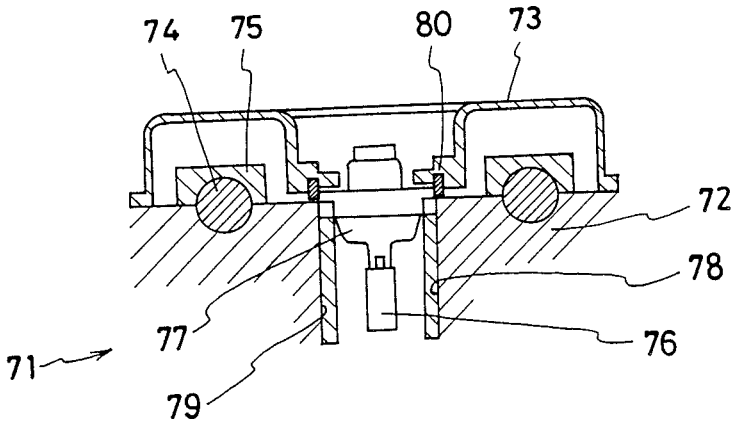
Fig. 5 (PRIOR ART)
FIG. 5 is a cross-sectional view of a conventional ignition device.

A C-shaped core 15 extends into a through hole 16 of a non-magnetic case 19 of the ignition device 10, and has ends defining a gap **15*a* that is located in the through hole 16. A center portion of the C-shaped core 15 is mounted above the case 19. The C-shaped core 15 is formed by plural stacked half-plates 15*b*, 15*c*, the stacks being jointed in face-to-face relation with each other (FIG. 4). The stacks of half-plates 15*b*, 15*c* are interposed between a pair of end plates 34 and are connected thereto with four rivets 20 to form a unified core. The end plates 34 each have a ribbed portion 35**.

In the case 19, a first coil 21 is wound on a first non-magnetic bobbin 22 and a second coil 23 is wound on a second non-magnetic bobbin 24 in a concentric relation with the first bobbin. A turn ratio between the first coil 21 and the second coil may be 1:100. After the bobbins 22, 24 are set into the case 19, a resin **19*a* is filled in the case 19 for fixing the bobbins 22, 24 in the case 19. It should be noted that FIG. 2 is a view before the resin 19*a*** is introduced.

Terminals 25,26 are output lines of the first coil 21. A terminal 27 is one of the output lines of the second coil 22. Another output line of the second coil 22 is connected to a terminal 28. The terminals 25,26 are connected to an electric circuit of an ignition system (not shown) by conductive wires 29,30. The terminal 27 is connected to the cylinder block by a conductive wire 31.

A lower portion of an ignition spark plug 32 is fixed to the cylinder head 12. An upper portion of the ignition spark plug 32 is connected to the terminal 28. The center portion of the ignition spark plug 32 is supported by the rubber sleeve 13. The ends of the core 15 are fitted in the bobbins so that the gap is in the bobbins.

The ignition device 10 is fixed in the depression 12*a* and a depression 11*a* of the cylinder head-cover 11. Namely, a lower portion of the ignition device 10 is supported in the cylinder head 12 in such manner that an inserting portion 10*a* of the ignition device 10 fits into the rubber sleeve 13, and an upper portion of the ignition device 10 is mounted on the cylinder headcover 11 in such manner that the C-shaped core 15 is supported by a cover 17 which is fixed to the cylinder head-cover 11. The core 15 is supported by the ignition cover 17 via a damper member 18 and a gasket 34.

The operation according to the foregoing embodiment is described hereinafter. When the engine 33 is operating, the ignition system sends ignition current to the ignition device via the wires 29 and 30. When the current flows through the first coil, electro-magnetic energy is stored in the gap 15*a*. When the electric circuit of the ignition system terminates the ignition current, the electro-magnetic energy in the gap is changed to high voltage electric energy. The high voltage electric energy flows through the second coil as a current. Thus, the current flows through the ignition spark plug, and a fuel-air mixture which is compressed in a cylinder (not shown) is ignited.

The above embodiment has the following advantages.

The ignition device can be removed for spark plug replacement by simply removing the cover 17.

The center portion of the C-shaped core 15 is mounted above the case 19, so that the width of the ignition device 10 is narrow. Therefore, the ignition device can be easily located in the depressions 11*a*, 12*a*, each of which is generally very narrow.

The cover 17 and the gasket 34 are located over the depressions 11*a* and 12*a*, so that dust does not invade thereinto.

The upper portion of the ignition device 10 is supported via the damper member, so that the vibration of the engine is restrained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An ignition device for an engine, comprising:

a case having a lower portion releasibly fittable around a spark plug mounted to a cylinder head of the engine;

a first bobbin having a first coil wound thereon, said first bobbin being supported by said case and said first coil being connectable to an ignition system of the engine;

a second bobbin having a second coil wound thereon, said second bobbin being supported by said case concentric with said first bobbin;

means for electrically connecting said second coil to a spark plug around which said lower portion of said case is fitted;

a C-shaped core positioned outside of said case and having distal ends fitted in said bobbins; and an ignition cover removably mounted to a cylinder head cover of the engine and supporting said core when said lower portion of said case is fitted around a spark plug, whereby said ignition device may be removed from the spark plug without removing the cylinder head cover.

2. The ignition device of claim 1 wherein a center part of said core is mounted above said case.

3. The ignition device of claim 2 including damper means and an ignition cover positioned between said core and said cylinder head cover such that said core is held by said cylinder head cover via said damper means and said ignition cover.

4. The ignition device of claim 1 wherein said distal ends of said core form a gap located in said bobbins, whereby electro-magnetic energy is transferred from said first coil to said second coil.

5. The ignition device of claim 1 wherein said lower portion of said case fits in a rubber sleeve fixed to the cylinder head around a hole for the spark plug.

6. The ignition device of claim 1 wherein said core is formed of two stacks of conductive plates held together by end pieces.

* * * * *